US008962736B2

(12) United States Patent
Law

(10) Patent No.: US 8,962,736 B2
(45) **Date of Patent: *Feb. 24, 2015**

(54) ELECTRICALLY RESISTIVE COATINGS/LAYERS USING SOLUBLE CARBON NANOTUBE COMPLEXES IN POLYMERS

(75) Inventor: Kock-yee Law, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 1217 days.

This patent is subject to a terminal disclaimer.

(21) Appl. No.: 11/961,600

(22) Filed: Dec. 20, 2007

(65) Prior Publication Data

US 2009/0162777 A1 Jun. 25, 2009

(51) Int. Cl.
*G03G 9/08* (2006.01)
*G03G 5/147* (2006.01)

(52) U.S. Cl.
CPC ..... *G03G 5/14704* (2013.01); *G03G 5/14708* (2013.01); *G03G 5/14726* (2013.01); *G03G 5/1473* (2013.01); *G03G 5/14752* (2013.01); *G03G 5/14756* (2013.01)
USPC ..... 524/495; 430/105; 430/109.3; 430/109.5

(58) Field of Classification Search
CPC ..... G03G 5/10; G03G 5/14; G03G 5/047; G03G 5/104; G03G 5/144; G03G 5/14704; G03G 5/1473; G03G 5/14752; G03G 5/14756; B82Y 30/00; B82Y 10/00; B82Y 40/00; C08K 3/04; C08K 2201/011; C08K 7/24
USPC ..... 524/498, 495, 496, 497; 430/59.1, 430/58.05, 58.7, 126, 109.3, 109.5, 105; 525/416; 252/511; 428/412; 399/297
See application file for complete search history.

(56) References Cited

U.S. PATENT DOCUMENTS

| | | | | |
|---|---|---|---|---|
| 6,141,516 | A | 10/2000 | Law et al. | |
| 6,203,855 | B1 | 3/2001 | Tarnawskyj et al. | |
| 6,620,476 | B2 | 9/2003 | Tarnawskyj et al. | |
| 2004/0034177 | A1* | 2/2004 | Chen | 525/416 |
| 2006/0001013 | A1* | 1/2006 | Dupire et al. | 252/511 |
| 2006/0269864 | A1* | 11/2006 | Tarnawskyj et al. | 430/124 |
| 2008/0038648 | A1* | 2/2008 | Bender et al. | 430/58.05 |
| 2008/0038650 | A1* | 2/2008 | Bender et al. | 430/59.1 |
| 2008/0306202 | A1* | 12/2008 | Lin et al. | 524/432 |
| 2009/0123185 | A1* | 5/2009 | Lin et al. | 399/176 |

OTHER PUBLICATIONS

Liu ("Homogeneous carbon nanotube/polymer composites for electrical applications"; Appl. Phys. Lett., vol. 83, No. 14, Oct. 6, 2003, 2928-2930).*

Chen et al., "Noncovalent Engineering of Carbon Nanotube Surfaces by Rigid, Functional Conjugated Polymers", JACS Communications, Jul. 13, 2002, pp. 9034-9035.

* cited by examiner

*Primary Examiner* — Ling Choi
*Assistant Examiner* — Chun-Cheng Wang
(74) *Attorney, Agent, or Firm* — MH2 Technology Law Group LLP

(57) ABSTRACT

A process and result for forming an electrically relaxable coating composite for an electrophotographic imaging component includes providing a non-functionalized soluble carbon nanotube complex, and mixing a polymer material with the soluble carbon nanotube complex. The electrically relaxable coating composite exhibits resistivity in the range or about $10^7$ to about $10^{12}$ ohm-cm.

16 Claims, 2 Drawing Sheets

ELECTRICALLY RESISTIVE COATINGS/LAYERS USING SOLUBLE CARBON NANOTUBE COMPLEXES IN POLYMERS

DESCRIPTION OF THE INVENTION

1. Field of the Invention

The present invention generally relates to use of carbon nanotubes in an electrophotographic imaging environment, and more specifically to electrically relaxable layers and coatings including soluble CNT complexes and polymers.

2. Background of the Invention

The present invention relates to a composite of a soluble carbon nanotube structure and a polymer material, and to a method of manufacturing the same.

Carbon nanotubes (CNTs), with their unique shapes and characteristics, are being considered for various applications. A carbon nanotube has a tubular shape of one-dimensional nature which can be grown through a nano metal particle catalyst. More specifically, carbon nanotubes can be synthesized by arc discharge or laser ablation of graphite. In addition, carbon nanotubes can be grown by a chemical vapor deposition (CVD) technique. With the CVD technique, there are also variations including plasma enhanced and so forth.

Carbon nanotubes can also be formed with a frame synthesis technique similar to that used to form fumed silica. In this technique, carbon atoms are first nucleated on the surface of the nano metal particles. Once supersaturation of carbon is reached, a tube of carbon will grow.

Regardless of the form of synthesis, and generally speaking, the diameter of the tube will be comparable to the size of the nanoparticle. Depending on the method of synthesis, reaction condition, the metal nanoparticles, temperature and many other parameters, the carbon nanotube can have just one wall, characterized as a single walled carbon nanotube, it can have two walls, characterized as a double walled carbon nanotube, or can be a multi-walled carbon nanotube. The purity, chirality, length, defect rate, etc. can be varying. Very often, after the carbon nanotube synthesis, there can occur a mixture of tubes with a distribution of all of the above, some long, some short. Some of the carbon nanotubes will be metallic and some will be semiconducting. Single wall carbon nanotubes can be about 1 nm in diameter whereas multi-wall carbon nanotubes can measure several tens nm in diameter, and both are far thinner than their predecessors, which are called carbon fibers. It will be appreciated that differences between carbon nanotube and carbon nano fiber is decreasing with the rapid advances in the field. For purposes of the present invention, it will be appreciated that the carbon nanotube is hollow, consisting of a "wrapped" graphene sheet. In contrast, while the carbon nano fiber is small, and can even be made in dimension comparable to some large carbon nanotubes, it is a solid structure rather than hollow.

Carbon nanotubes in the present invention can include ones that are not exactly shaped like a tube, such as: a carbon nanohorn (a horn-shaped carbon nanotube whose diameter continuously increases from one end toward the other end) which is a variant of a single-wall carbon nanotube; a carbon nanocoil (a coil-shaped carbon nanotube forming a spiral when viewed in entirety); a carbon nanobead (a spherical bead made of amorphous carbon or the like with its center pierced by a tube); a cup-stacked nanotube; and a carbon nanotube with its outer periphery covered with a carbon nanohorn or amorphous carbon.

Furthermore, carbon nanotubes in the present invention can include ones that contain some substances inside, such as: a metal-containing nanotube which is a carbon nanotube containing metal or the like; and a peapod nanotube which is a carbon nanotube containing a fullerene or a metal-containing fullerene.

As described above, in the present invention, it is possible to employ carbon nanotubes of any form, including common carbon nanotubes, variants of the common carbon nanotubes, and carbon nanotubes with various modifications, without a problem in terms of reactivity. Therefore, the concept of "carbon nanotube" in the present invention encompasses all of the above.

One of the characteristics of carbon nanotubes resides in that the aspect ratio of length to diameter is very large since the length of carbon nanotubes is on the order of micrometers. Depending upon the chirality, carbon nanotubes can be metallic and semiconducting.

Carbon nanotubes excel not only in electrical characteristics but also in mechanical characteristics. That is, the carbon nanotubes are distinctively tough, as attested by their Young's moduli exceeding 1 TPa, which belies their extreme lightness resulting from being formed solely of carbon atoms. In addition, the carbon nanotubes have high elasticity and resiliency resulting from their cage structure. Having such various and excellent characteristics, carbon nanotubes are very appealing as industrial materials.

Applied research that exploits the excellent characteristics of carbon nanotubes has been extensive. To give a few examples, a carbon nanotube is added as a resin reinforcer or as a conductive composite material while another research uses a carbon nanotube as a probe of a scanning probe microscope. Carbon nanotubes have also been used as minute electron sources, field emission electronic devices, and flat displays.

As described above, carbon nanotubes can find use in various applications. In particular, the applications of the carbon nanotubes to electronic materials and electronic devices have been attracting attention. In an electrophotographic imaging process, an electric field can be created by applying a bias voltage to the electrophotographic imaging components, consisting of resistive coating or layers. Further, the coatings and material layers are subjected to a bias voltage such that an electric field can be created in the coatings and material layers when the bias voltage is ON and be sufficiently electrically relaxable when the bias voltage is OFF so that electrostatic charges are not accumulated after an electrophotographic imaging process. The fields created are used to manipulate unfused toner image along the paper path, for example from photoreceptor to an intermediate transfer belt and from the intermediate transfer belt to paper, before fusing to form the fixed images. These electrically resistive coatings and material layers are typically required to exhibit resistivity in a range of about $10^7$ to about $10^{12}$ ohm-cm and should possess mechanical and/or surface properties suitable for a particular application or use on a particular component.

It has been difficult to consistently achieve this desired range of resistivity with known coating materials. Two approaches have been used in the past, including ionic filler and particle filler; however, neither approach can consistently meet complex design requirements without some trade off. For example, coatings with ionic filler have better dielectric strength (high breakdown voltage), but the conductivity is very sensitive to humidity and/or temperature. In contrast, the conductivity of particle filler systems are usually less sensitive to environmental changes, but the breakdown voltage tends to be low.

More recently, carbon nanotubes have been used in polyimide and other polymeric systems to produce composites with resistivity in a range suitable for electrophotographic imaging devices. Since carbon nanotube is conductive with very high aspect ratio, the desirable conductivity, about $10^7$ to about $10^{12}$ ohm-cm, can be achieved with very low filler loading. The advantage of that is that, carbon nanotube will not change the property of the polymer binder at this loading level. This will open up design space for the selection of polymer binder for a given application.

However, carbon nanotubes were believed insoluble in a solvent and applications were limited to those materials using carbon nanotube dispersion. In a typical preparation of a filled polymer coating, mixing and blending are used to prepare a dispersion and then a coating. Even when carbon nanotubes are blended with polymers, the dispersion can be unsuitable depending upon the process. In the intended resistivity range of about $10^7$ to about $10^{12}$, it is difficult to prepare reliable relaxable materials using the usual dispersion techniques, which dispersions are also suitable for electrophotographic imaging applications. The resistivity of conductor-filled composites, including carbon nanotube composites, is very sensitive to the details of the dispersion process. To date, the most reproducible layer fabrications are based on solution coating (e.g. PR charge transport layer (CTL) coatings). For at least these reasons, carbon nanotube composites have not been looked to for use in electrophotographic imaging applications.

Accordingly, alternatives are sought to enable the use of carbon nanotubes in electrophotographic imaging applications, particularly in the coatings and materials of certain components such as, for example, bias charging roll (BCR), bias transfer roll (BTR), magnetic roller sleeve, intermediate transfer belt, and transfer belt.

Thus, there is a need to overcome these and other problems of the prior art and to provide a method and apparatus for preparing electrically relaxable materials based on soluble forms of carbon nanotubes in combination with a polymer and the use of these composite materials for electrophotographic imaging applications in the resistivity range of interest.

SUMMARY OF THE INVENTION

Nanotube technologies provide the opportunity to achieve such efficiencies. Carbon nanotubes exhibit extraordinary electrical, mechanical and thermal conductivity properties. The thermal conductivity, for example, is much higher than that of copper. Nanotubes can be synthesized by a number of methods including carbon arc discharge, pulsed laser vaporization, chemical vapor deposition (CVD) and high-pressure carbon monoxide vaporization. Of these, carbon nanotube synthesis by CVD can provide bulk production of high purity and easily dispersible product. It should be appreciated that other material variants of carbon nanotubes can be used for electrophotographic imaging devices such as those disclosed herein.

In simplest terms, a carbon nanotube, on a microscopic scale, appears like a hexagonally shaped poultry wire mesh formed of hexagonal carbon rings. Carbon nanotube is very conducting because of its unique electronic structure.

The present invention is particularly directed to use of a soluble carbon nanotube to prepare the dispersion. This will enhance dispersion and coating quality. Generally speaking, there are two approaches to modify carbon nanotube to solubilized it or make it more compatible to polymer or solvent. One approach is to co-valently form a chemical bond to the carbon nanotube. This approach essentially creates defects on the tube and very often destroys desired properties. Another approach is to use surfactants such as sodium dodecyl sulfate and polymers. Yet another approach is to solubilize carbon nanotube by wrapping a polymer chain onto the carbon nanotube. Examples of these polymer chains can be found in Zyvex products, or DNA as used by DuPont. In the case of solubilization achieved by wrapping a polymer chain onto the carbon nanotube, the solubilization enhances solubility in solvent and dispersity in polymer. Although such an approach may perturb the electronic property of the carbon nanotube, it represents a good compromise. In exemplary embodiments herein, solubilization is achieved without functionalizing the carbon nanotube with a functional group as previously done in the art. In other words, no chemical bond is formed. This can be referred to as complexation between the carbon nanotube and the polymer. Once a chemical bond is formed, the electronic properties of the carbon nanotube can be changed. Thus in the current example, the carbon nanotube material is solubilized and the electronic property remains the same.

In 2002, Chen et al. (J. Chen et al. J. Am. Chem. Soc., 124, 9034-9035 (2002)), and referring to FIGS. 1A and 1B, a soluble carbon nanotube 100 is depicted in each of a side perspective and end perspective views. The soluble carbon nanotube (CNT) 100 is obtained in a known process described in Chen et al. by reacting carbon nanotube (CNT) 110 with a poly(aryleneethyinylene) 120 in chloroform to obtain a complex formed via π-π interaction. A resulting carbon nanotube concentration equivalent to 2.2 mg/mL is obtained.

Therefore, the present invention has been made in view of the above circumstances and provides a soluble CNT-polymer composite of an optimal resistivity for use in electrophotographic imaging components. The above composite is achieved through the following present invention.

In accordance with the present teachings, an electrically relaxable coating composite for electrophotographic imaging components is provided.

The exemplary composite can include a soluble carbon nanotube complex and a polymer material combined with the soluble carbon nanotube complex.

In accordance with the present teachings, a process for forming an electrically relaxable coating composite is provided.

The exemplary process can include providing a soluble carbon nanotube complex and mixing a polymer material with the soluble carbon nanotube complex. The exemplary process can further include applying the coating composite to a substrate of an electrophotographic imaging component.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE EMBODIMENTS

Reference will now be made in detail to the exemplary embodiments of the invention, examples of which are illustrated in the accompanying drawings. However, one of ordinary skill in the art would readily recognize that the same principles are equally applicable to, and can be implemented in devices other than coatings and layers for electrophotographic imaging type devices, and that any such variations do not depart from the true spirit and scope of the present invention. Moreover, in the following detailed description, references are made to the accompanying figures, which illustrate specific embodiments. Electrical, mechanical, logical and structural changes may be made to the embodiments without departing from the spirit and scope of the present invention. The following detailed description is, therefore, not to be taken in a limiting sense and the scope of the present invention is defined by the appended claims and their equivalents. Wherever possible, the same reference numbers will be used throughout the drawings to refer to the same or like parts.

Embodiments pertain generally to solutions for obtaining electrically resistive coatings or layers in components of electrophotographic imaging devices. More specifically, the solutions can be applicable to obtaining soluble CNT/polymer coatings of a predetermined resistivity range. Soluble CNT can result in more uniform distribution of CNT in a polymer or other bulk material, thereby improving processing latitude.

To improve the quality of the CNT/polymer dispersion as well as the process latitude of the fabrication and coating steps, the present invention provides a composite including a soluble form of CNT and disperses these soluble CNTs in polymers for applications in electrophotographic imaging devices. Exemplary imaging device components suitable for coating by the novel composite can include a biased charge roll (BCR), biased transfer roll (BTR), magnetic roll sleeve, intermediate transfer belt, transfer belt, etc.

Figure 1A:
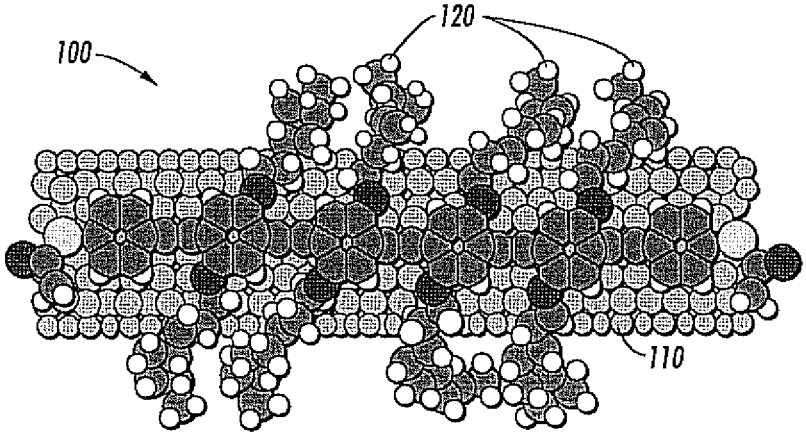
FIG. 1A is a side perspective view and FIG. 1B is an end perspective view taken along line B-B of FIG. 1A depicting a molecular model of a carbon nanotube complex in accordance with embodiments of the present teachings.
Figure 1B:
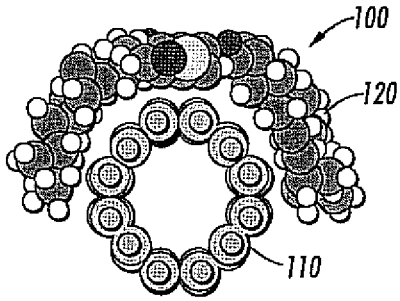

It is known that CNT can be solubilized by a complexation process as described above in connection with FIGS. 1A and 1B and the Chen et al. model. The soluble CNT complex is non-functionalized, and as depicted in FIGS. 1A and 1B is utilized in the following.

Figure 2:
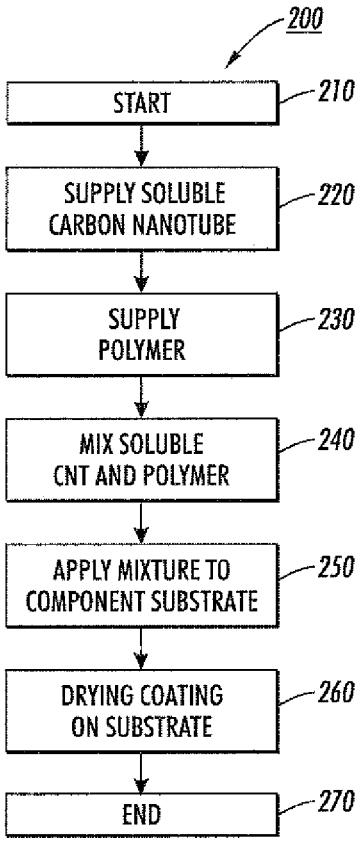
FIG. 2 is a process diagram in accordance with exemplary embodiments of the present teachings.

Referring to the process 200 of FIG. 2, and starting at 210, an amount of non-functionalized soluble carbon nanotube complex 100 is provided at 220 and an amount of polymer is supplied at 230. The non-functionalized soluble carbon nanotube complex is mixed, blended, or otherwise combined with the polymer at 240 to form a coating solution or dispersion or a usable composite. Typically, the coating material will be in a liquid or viscous form, suitable for application to a substrate. The coating material is applied to the substrate at 250, followed by curing, drying 260 or other suitable treatment for binding the coated layer to the selected substrate. The process ends at 270 and the thus coated component is ready for use in an electrophotographic imaging device.

The carbon nanotubes can be any of single wall carbon nanotube, double wall carbon nanotube, multiwall carbon nanotube, or a mixture thereof. Length, diameter, and chirality can vary according to processing methods, duration and temperature of the synthesis. Likewise, purity can vary according to processing parameters.

It will be further appreciated that the soluble CNT/polymer composite can be provided on the substrate in a pattern, or as a uniform coating according to an end application of the imaging device component.

The coating can be applied using any conventional technique, e.g. dip, spin, spray, draw-down, flow-coat, extrusion, etc. CNT is well known to be able to produce the resistivity range of interest (about $10^7$ to about $10^{12}$ ohm-cm) at very low loading and, without being limited to theory, the resulting CNT: poly(aryleneethylnylene) complex will perform similarly in polymers.

The soluble CNT complex can be combined with a polymer, either as a mixture in predetermined proportions or by other suitable methods. In one example of a coating material, multiwall carbon nanotube is mixed with a polycarbonate. At 2.5% loading, a surface resistivity of about $10^{-10}$ Ohm per square centimeter was obtained. An exemplary polymer for BCR/BTR is nylon or acrylic resin and optionally fluorinated polymer. In addition, a fluoroelastomer can be used, similar to that described in U.S. Pat. Nos. 6,141,516 and 6,203,855, incorporated by reference herein in their entirety. An example of nylon suitable for use in the present invention is found in U.S. Pat. No. 6,620,476, incorporated by reference herein in its entirety.

Exemplary loading for multiwall carbon nanotube can be in the range of about 0.5% to about 4% depending upon polymer binder, solvent, thickness and other coating variations.

For example, an amount of soluble CNT complex is mixed to obtain a unified coating material of a consistency or amount suitable for application to a substrate. The substrate can be a belt, roll, or other substrate requiring a resistivity in the range defined by the coating.

In embodiments, the coatings provided are useful in various charge transport and electron transport applications and devices, for example, as a thin film electrode or contact modification layer in electroluminescent devices to facilitate charge injection.

Drying or curing of the coated layer can be, for example, less than about 150° C. A coating thickness can be in the range of about 3 to about 50 microns. Further, a coating thickness can be in the range of about 5 to about 25 microns.

Exemplary polymers for combination with the soluble CNT complex can include nylons and other acrylic resins. Use of a low surface energy polymer can reduce surface contamination, and therefore partially fluorinated polymeric materials can also be used. Other exemplary polymers can include polycarbonates, polyesters (PMMA), polyacrylates, polvinylclorides, polystyrenes, polyurethanes, etc.

The electrically relaxable layers or coatings prepared from soluble CNT complexes and polymers as applied to substrates and/or component surfaces, render the component surfaces electrically relaxable with resistivity in the range of about $10^7$ to about $10^{12}$ to about ohm-cm.

Although the relationships of components are described in general terms, it will be appreciated that one of skill in the art can add, remove, or modify certain components without departing from the scope of the exemplary embodiments.

It will be appreciated by those of skill in the art that several benefits are achieved by the exemplary embodiments described herein and include reduced costs, fewer components, elimination of chemical mechanical polishing, increased accuracy of components, and removal of alignment errors.

While the invention has been illustrated with respect to one or more exemplary embodiments, alterations and/or modifications can be made to the illustrated examples without departing from the spirit and scope of the appended claims. In particular, although the method has been described by examples, the steps of the method may be performed in a different order than illustrated or simultaneously. In addition, while a particular feature of the invention may have been disclosed with respect to only one of several embodiments, such feature may be combined with one or more other features of the other embodiments as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." And as used herein, the term "one or more of" with respect to a listing of items such as, for example, "one or more of A and B," means A alone, B alone, or A and B.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any an all sub-ranges between (and including) the minimum value of zero and the maximum value of 10, that is, any and all sub-ranges having a minimum value of equal to or greater than zero and a maximum value of equal to or less than 10, e.g., 1 to 5.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. An electrophotographic imaging component comprising:

a substrate; and an electrically relaxable coating composite formed on the substrate, the coating composite having an electrical resistivity in a range of about $10^7$ to about $10^{12}$ ohm-cm and comprising a polymer material combined with a soluble carbon nanotube complex to obtain a dispersion of the soluble carbon nanotube complex in the polymer material suitable for electrophotographic imaging, wherein the polymer material comprises polycarbonate, polyacrylate, or polystyrene, and wherein the soluble carbon nanotube complex comprises a polymer wrapped carbon nanotube and there is no chemical bond between the polymer wrap and the carbon nanotube.

2. The coating composite of claim 1, wherein the imaging component comprises any of a bias charge roll, a bias transfer roll, a magnetic roller sleeve, intermediate transfer belt, and a transfer belt.

3. The coating composite of claim 1, wherein the polymer material further comprises nylon.

4. The coating composite of claim 1, wherein the polymer material further comprises acrylic resin.

5. The coating composite of claim 1, wherein the polymer material further comprises polyester.

6. The coating composite of claim 1, wherein the polymer material further comprises polyvinylchloride.

7. The coating composite of claim 1, wherein the carbon nanotube complex comprises single wall carbon nanotube, double wall carbon nanotube, multiwall carbon nanotube or mixture thereof.

8. The electrophotographic imaging component of claim 1, wherein the polymer wrap comprises poly(aryleneethylnylene).

9. A process for forming an electrophotographic imaging component comprising:

forming an electrically relaxable coating composite having an electrical resistivity in a range of about $10^7$ to about $10^{12}$ ohm-cm, comprising:

providing a soluble carbon nanotube complex comprising a polymer wrapped carbon nanotube, wherein there is no chemical bond between the polymer wrap and the carbon nanotube; and mixing a polymer material with the soluble carbon nanotube complex to obtain a dispersion of the soluble carbon nanotube complex in the polymer material suitable for electrophotographic imaging, wherein mixing the polymer material comprises mixing polycarbonate, polyacrylate, or polystyrene; and applying the coating composite to a substrate of the electrophotographic imaging component.

10. The process of claim 9, further comprising applying the coating composite to a substrate of an electrophotographic imaging component.

11. The process of claim 9, wherein mixing the polymer material further comprises mixing a nylon.

12. The process of claim 9, wherein mixing the polymer material further comprises mixing acrylic resin.

13. The process of claim 9, wherein mixing the polymer material further comprises mixing one of a polyester and polyvinylchloride.

14. The process of claim 9, wherein the coating comprises a concentration of carbon nanotube having a loading of about 0.01% to about 10% of the coating.

15. The process of claim 9, wherein the loading is about 0.05% to about 5%.

16. The process of claim 9, wherein the polymer wrap comprises poly(aryleneethylnylene).

* * * * *